US009356365B2

(12) United States Patent
Yamada et al.

(10) Patent No.: US 9,356,365 B2
(45) Date of Patent: May 31, 2016

(54) CABLE CONNECTION STRUCTURE

(75) Inventors: Junya Yamada, Hachioji (JP); Mikio Nakamura, Tokyo (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 13/613,912

(22) Filed: Sep. 13, 2012

(65) Prior Publication Data

US 2013/0005181 A1 Jan. 3, 2013

Related U.S. Application Data

(63) Continuation of application No. PCT/JP2011/057030, filed on Mar. 23, 2011.

(30) Foreign Application Priority Data

Apr. 8, 2010 (JP) ..... 2010-089788

(51) Int. Cl.
*H01R 9/05* (2006.01)
*H01R 4/02* (2006.01)

(52) U.S. Cl.
CPC ..... *H01R 9/0515* (2013.01); *H01R 4/02* (2013.01)

(58) Field of Classification Search
None
See application file for complete search history.

(56) References Cited

U.S. PATENT DOCUMENTS 6,842,093 B2 * 1/2005 Tamaki et al. ..... 333/260
6,857,898 B2 * 2/2005 Engquist ..... H01R 9/0515 439/493
7,498,523 B2 * 3/2009 Miller ..... H01R 9/0515 174/261
2007/0181337 A1 8/2007 Miller
2009/0090452 A1 4/2009 Naba et al.
2009/0120662 A1 5/2009 Tanaka
2012/0258613 A1 * 10/2012 Nakamura ..... 439/63

FOREIGN PATENT DOCUMENTS

CH DE 102004060416 A1 * 6/2006 ..... H05K 3/3405
CN 101442158 A 5/2009
DE 10 2004 060 416 A1 6/2006
EP 2 031 430 A2 3/2009
JP 01-139365 9/1989
JP 09-252167 9/1997
JP 09252167 A * 9/1997
JP 11-352413 A 12/1999

(Continued)

OTHER PUBLICATIONS

Extended Supplementary European Search Report dated Apr. 17, 2014 from related European Application No. 11 76 5403.8.

(Continued)

*Primary Examiner* — William H Mayo, III
*Assistant Examiner* — Krystal Robinson
(74) *Attorney, Agent, or Firm* — Scully, Scott, Murphy & Presser, P.C.

(57) ABSTRACT

A cable connection structure includes a cable that has an outer skin and at least one conducting wire, and a substrate to which the cable is connected at a main surface side having a hard wiring, wherein the substrate includes, at the main surface side, a first flat section having flatness and a second flat section having flatness thinner than the first flat section via a level difference surface from the first flat section and an end part of the outer skin is arranged on the second flat section and at least one of the conducting wire is connected to a connecting electrode formed on the second flat section.

2 Claims, 5 Drawing Sheets

(56) References Cited

FOREIGN PATENT DOCUMENTS

| | | | | |
|---|---|---|---|---|
| JP | 2001-54194 | A | | 2/2001 |
| JP | 200-068175 | | | 3/2001 |
| JP | 2001-320208 | A | | 11/2001 |
| JP | 2003-338693 | A | | 11/2003 |
| JP | 2007-134126 | | | 5/2007 |
| JP | 2007134126 | A | * | 5/2007 |
| JP | 2007-265770 | A | | 10/2007 |
| JP | 2009-58807 | A | | 3/2009 |
| JP | 2009-081009 | | | 4/2009 |
| JP | 2009-123459 | A | | 6/2009 |
| JP | 2011-134613 | A | | 7/2011 |

OTHER PUBLICATIONS

International Search Report dated Apr. 26, 2011 ssued in PCT/JP2011/057030.

Notice of Rejection dated Apr. 1, 2014 from related Japanese Application No. 2010-089788, together with an English language translation.

Decision of a Patent Grant dated Sep. 24, 2014 from related Japanese Application No. 2010-089788.

European Patent Convention Communication dated Apr. 13, 2015, from corresponding European Application No. 11 765 403.8.

* cited by examiner

CABLE CONNECTION STRUCTURE

CROSS-REFERENCE TO RELATED APPLICATION

This application is a continuation of International Application No. PCT/JP2011/057030, designating the United States and filed on Mar. 23, 2011 which claims the benefit of priority of the prior Japanese Patent Application No. 2010-089788, filed on Apr. 8, 2010, and the entire contents of the International application and the Japanese Application are incorporated herein by reference.

BACKGROUND OF THE INVENTION

1. Field of the Invention

The present invention relates to a cable connection structure in which a coaxial cable is connected to a substrate.

2. Description of the Related Art

As a structure for connecting a coaxial cable, a structure in which a slit is provided on an upper surface of a printed circuit substrate and a pattern for connection with an external conductor is formed at both sides of the slit has been known as disclosed in Japanese Patent Application Laid-Open No. 2001-68175. According to the technique disclosed in Japanese Patent Application Laid-Open No. 2001-68175, the external conductor of the coaxial cable is placed in the slit provided in the printed circuit substrate and can be connected to the pattern for connection at both sides of the slit, so that it is possible to make a height of an attachment of the coaxial cable low by a portion by which the external conductor drops in the slit.

SUMMARY OF THE INVENTION

According to an aspect of the present invention, a cable connection structure includes a cable that has an outer skin and at least one conducting wire, and a substrate to which the cable is connected at a main surface side having a hard wiring, wherein the substrate includes, at the main surface side, a first flat section having flatness and a second flat section having flatness thinner than the first flat section via a level difference surface from the first flat section and an end part of the outer skin is arranged on the second flat section and at least one of the conducting wire is connected to a connecting electrode formed on the second flat section.

The above and other features, advantages, and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a cable connection structure according to the present invention will be explained below with reference to the accompanying drawings. It should be noted that the present invention is not limited to the embodiments. It should also be noted that the same part is assigned with the same reference symbol through the description of the drawings.

First Embodiment

Figure 1:
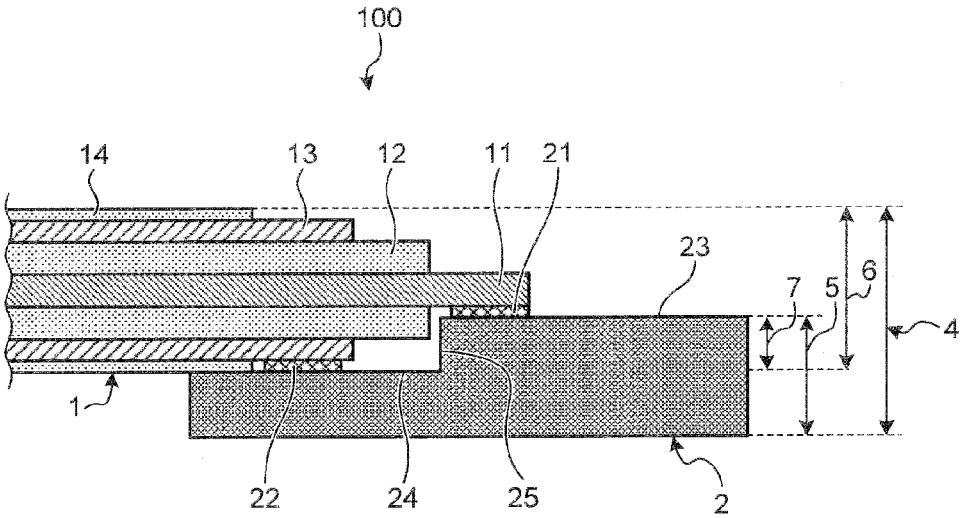
FIG. 1 is a partial cross sectional view of a cable connection structure according to a first embodiment.
Figure 2:
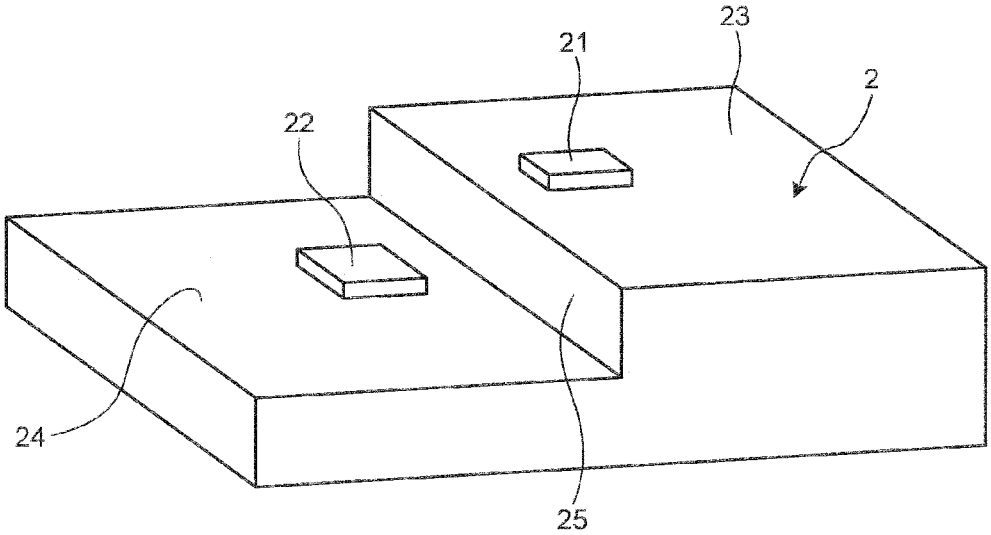
FIG. 2 is a perspective view of a configuration of the substrate according to the first embodiment.

FIG. 1 is a partial cross sectional view of a cable connection structure 100 according to a first embodiment. FIG. 2 is a perspective view of a configuration of a substrate 2 to which a coaxial cable 1 is connected by the cable connection structure 100 according to the first embodiment. The cable connection structure 100 is provided with the coaxial cable 1 and the substrate 2 to which the coaxial cable 1 is connected as shown in FIG. 1.

The coaxial cable 1 is provided with a center conductor 11 as a core wire, an internal insulator 12 provided in an outer circumference of the center conductor 11, an external conductor 13 as a shielding wire that covers an outer circumference of the internal insulator 12, and an outer insulator 14 provided in an outer circumference of the external conductor 13.

The substrate 2 is provided with a first flat section 23 having flatness and a second flat section 24 that has a surface flush with the first flat section 23 and has flatness whose thickness is less than that of the first flat section 23 as shown in FIG. 2. A level difference surface 25 formed in a boundary between the first flat section 23 and the second flat section 24 is formed perpendicularly to a main surface of the first flat section 23 and a main surface of the second flat section 24. In other words, the first flat section 23 and the second flat section 24 are formed via the level difference surface 25. Besides, a center conductor connecting electrode 21 to which an end part of the center conductor 11 is connected is formed on the main surface of the first flat section 23 and an external conductor connecting electrode 22 to which an end part of the external conductor 13 is connected is formed on the main surface of the second flat section 24.

The level difference surface 25 of the substrate 2 is formed by performing a process such as an etching only on a predetermined area of a predetermined surface of the substrate 2. After forming the level difference surface 25, the external conductor connecting electrode 22 is formed on the main surface of the second flat section 24 and the center conductor connecting electrode 21 is formed on the main surface of the first flat section 23. In the case of forming the level difference surface 25 by etching and the like, a silicon substrate is preferably used.

For the substrate 2, a ceramic substrate and the like may be applied and the level difference surface 25 in a ceramic substrate is formed by laminating ceramic layers only at a predetermined area of a predetermined surface of the substrate 2.

Then, the end part of the center conductor 11 of the coaxial cable 1 and the center conductor connecting electrode 21, and the end part of the external conductor 13 and the external conductor connecting electrode 22 are electrically and mechanically connected by using a conductive bonding member, not shown, such as a solder, an anisotropically-conductive film (ACF), and an anisotropically-conductive paste (ACP).

As explained so far, the coaxial cable 1 and the substrate 2 are connected by arranging the conductive bonding member such as a solder, bonding the end part of the center conductor 11 of the coaxial cable 1 and the center conductor connecting electrode 21 formed on the main surface of the first flat section 23 of the substrate 2, and bonding the end part of the external conductor 13 and the external conductor connecting electrode 22 formed on the main surface of the flat section 24 in the cable connection structure 100 according to the first embodiment. Thus, it is possible to reduce a height 4 of the attachment part of the coaxial cable 1 with respect to the substrate 2 in the cable connection structure 100 by a height 7 of the level difference surface 25 of the substrate 2 from a total height of a thickness 5 of the first flat section 23 of the substrate 2 and a diameter 6 of the coaxial cable 1.

Thanks to the effect in the cable connection structure 100 according to the first embodiment, it becomes possible to suppress an increase in the height 4 of the attachment part of the coaxial cable 1 and connect the coaxial cable 1 to the substrate 2. Specifically, it is possible to reduce the height 4 of the attachment part of the coaxial cable 1 by the height 7 of the level difference surface 25. Therefore, it is possible to suppress an increase, associated with the connection of the coaxial cable 1, in the direction of the thickness of the substrate 2. The cable connection structure 100 can be applied to a connection between an ultrasonic transducer of an ultrasonic endoscope and a coaxial cable, for example.

Second Embodiment

Figure 3:
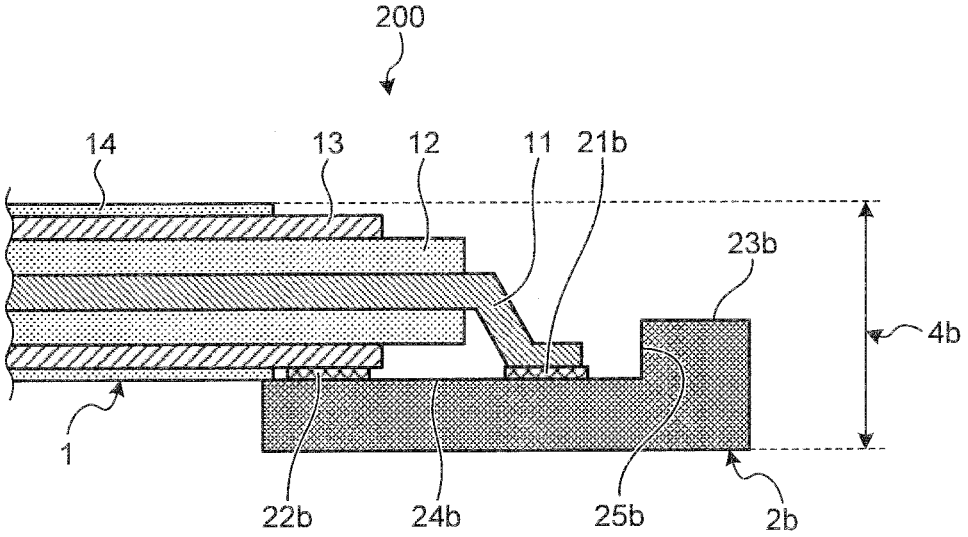
FIG. 3 is a partial cross sectional view of a cable connection structure according to a second embodiment.

FIG. 3 is a partial cross sectional view of a cable connection structure 200 according to a second embodiment. In FIG. 3, the same part as the first embodiment is assigned with the same reference symbol. As shown in FIG. 3, a center conductor connecting electrode 21*b* of a substrate 2*b* is formed on a main surface of a second flat section 24*b* in the cable connection structure 200 according to the second embodiment.

The coaxial cable 1 and the substrate 2*b* are electrically and mechanically connected by a conductive bonding member, not shown, such as a solder and an ACF similarly to the first embodiment. Specifically, the end part of the center conductor 11 of the coaxial cable 1 and the center conductor connecting electrode 21*b*, and the end part of the external conductor 13 and an external conductor connecting electrode 22*b* are electrically and mechanically connected by a conductive bonding member, not shown, such as a solder, an ACF, and an ACP.

As explained so far, it is possible in the cable connection structure 200 according to the second embodiment to obtain the same effect as the first embodiment. Besides, since the center conductor connecting electrode 21*b* of the substrate 2*b* is formed on the main surface of the second flat section 24*b*, it is possible to connect the coaxial cable 1 to the substrate 2*b* by using a general cable connection method of connecting a cable to a flat substrate surface.

Thanks to the effect, it is possible in the cable connection structure 200 according to the second embodiment to obtain the same advantageous effects as the first embodiment. In addition, since a center conductor connecting part (the center conductor 11 and the center conductor connecting electrode 21*b*) and an external electrode connecting part (the external electrode 13 and the external conductor connecting electrode 22*b*) are placed on the same main surface of the second flat section 24*b* and thereby there is no difference in heating conditions in connection due to the formation of respective connecting electrodes on different flat sections or no necessity of taking a difference in shape of connection parts into consideration, it is possible to realize a joint at the same time in the same process by using conventional cable connecting methods and to make the connection of the coaxial cable 1 to the substrate 2*b* easy. The cable connection structure 200 can be applied to a connection between an ultrasonic transducer of an ultrasonic endoscope and a coaxial cable, for example.

Third Embodiment

Figure 4:
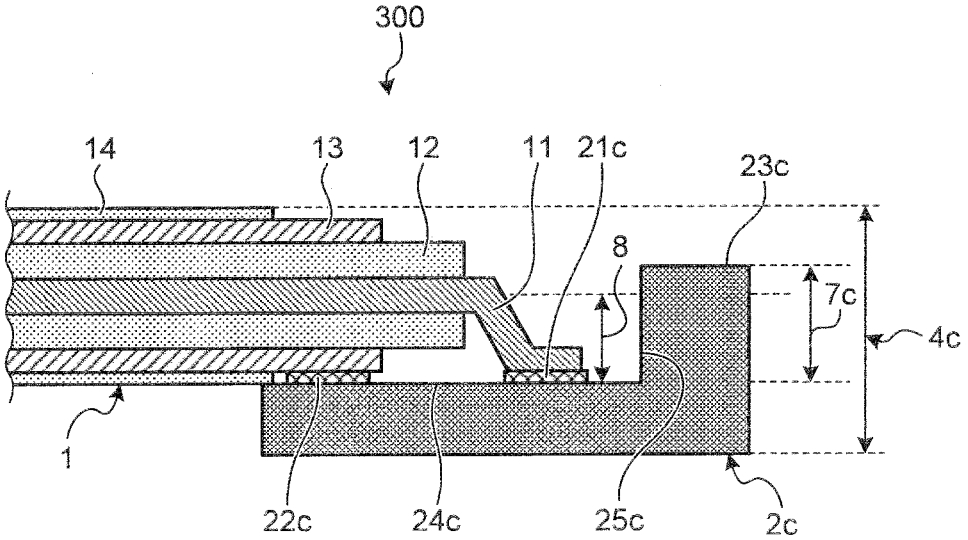
FIG. 4 is a partial cross sectional view of a cable connection structure according to a third embodiment.

FIG. 4 is a partial cross sectional view of a cable connection structure 300 according to a third embodiment. In FIG. 4, the same part as the first and the second embodiments is assigned with the same reference symbol. As shown in FIG. 4, a level difference surface 25*c* between a first flat section 23*c* and a second flat section 24*c* of a substrate 2*c* has a height equal to or more than a radius of the coaxial cable 1 in the cable connection structure 300 according to the third embodiment.

The coaxial cable 1 and the substrate 2*c* are electrically and mechanically connected by a conductive bonding member, not shown, such as a solder and an ACF similarly to the first and the second embodiments. Specifically, the end part of the center conductor 11 of the coaxial cable 1 and a center conductor connecting electrode 21*c*, and the end part of the external conductor 13 and an external conductor connecting electrode 22*c* are electrically and mechanically connected by a conductive bonding member, not shown, such as a solder, an ACF, and an ACP.

As explained so far, it is possible in the cable connection structure 300 according to the third embodiment to obtain the same effect as the first and the second embodiments. Besides, since a height 7*c* of the level difference surface 25*c* between the first flat section 23*c* and the second flat section 24*c* of the substrate 2*c* is configured to be equal to or more than a radius 8 of the coaxial cable 1, it is possible to reduce a height 4*c* of the attachment part of the coaxial cable 1 to the substrate 2*c* by not less than the radius 8 of the coaxial cable 1.

Thanks to the effect, it is possible in the cable connection structure 300 according to the third embodiment to obtain the same advantageous effects as the first and the second embodiments. In addition, it is possible to make the height 4*c* of the cable attachment in the cable connection structure 300 according to the third embodiment substantially less than the cable attachment height in conventional techniques. Specifically, it is only possible in the conventional techniques to reduce the attachment height of the coaxial cable 1 to such a degree as to be less than the depth of the slit or less than the radius of the external conductor and moreover it is impossible to realize a reduction to such a degree as to be equal to or more than the radius of the coaxial cable. This is because there is a necessity of making the slit equal to or more than the diameter of the external conductor to reduce the cable attachment height by not less than the radius of the external conductor in the conventional techniques and it is impossible in that case to connect the external conductor with no contact on the substrate. In the third embodiment, it is possible to easily obtain a good connection since the attachment height of the coaxial cable 1 can be reduced substantially by making the height 7*c* of the level difference surface 25*c* between the first flat section 23*c* and the second flat section 24*c* of the substrate 2*c* equal to or more than the radius 8 of the coaxial cable 1 and besides there is no possibility that a contact area between the end part of the external conductor 13 of the coaxial cable 1 and the external conductor contacting electrode 22*c* becomes small. The cable connection structure 300 can be applied to a connection between an ultrasonic transducer of an ultrasonic endoscope and a coaxial cable, for example.

Fourth Embodiment

Figure 5:
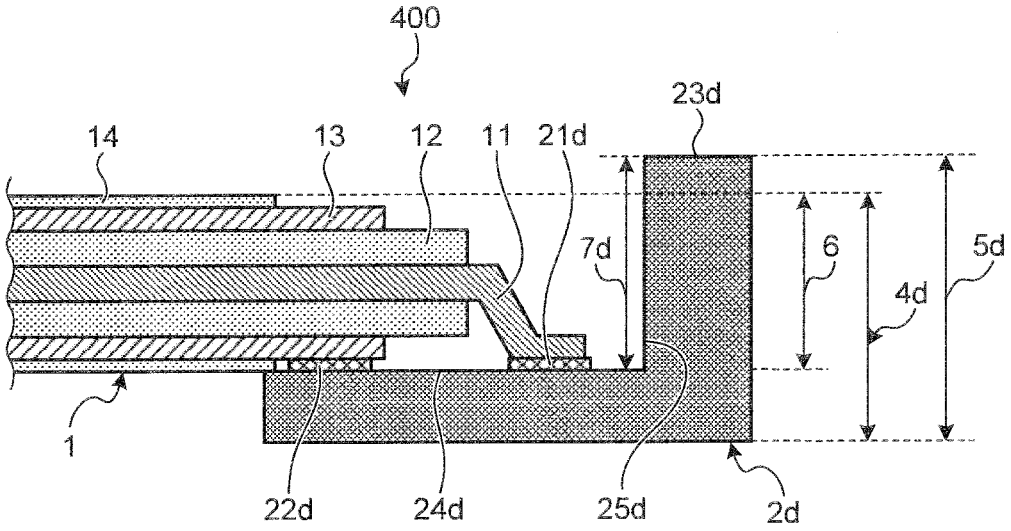
FIG. 5 is a partial cross sectional view of a cable connection structure according to a fourth embodiment.

FIG. 5 is a partial cross sectional view of a cable connection structure 400 according to a fourth embodiment. In FIG. 5, the same part as the first to the third embodiments is assigned with the same reference symbol. As shown in FIG. 5, a height 7*d* of a level difference surface 25*d* between a first flat section 23*d* and a second flat section 24*d* of a substrate 2*d* is equal to or more than the diameter 6 of the coaxial cable 1 in the cable connection structure 400 according to the fourth embodiment.

The coaxial cable 1 and the substrate 2*d* are electrically and mechanically connected by a conductive bonding member, not shown, such as a solder and an ACF similarly to the first to the third embodiments. Specifically, the end part of the center conductor 11 of the coaxial cable 1 and a center conductor connecting electrode 21*d*, and the end part of the external conductor 13 and an external conductor connecting electrode 22*d* are electrically and mechanically connected by a conductive bonding member, not shown, such as a solder, an ACF, and an ACP.

As explained so far, it is possible in the cable connection structure 400 according to the fourth embodiment to obtain the same effect as the first to the third embodiments. Besides, since the height 7*d* of the level difference surface 25*d* between the first flat section 23*d* and the second flat section 24*d* of the substrate 2*d* is configured to be equal to or more than the diameter 6 of the coaxial cable 1, it is possible to suppress a height 4*d* of the attachment part of the coaxial cable 1 to the substrate 2*d* to such a degree as to be not more than a thickness 5*d* of the first flat section 23*d* of the substrate 2*d*.

Thanks to the effect explained above, it is possible in the cable connection structure 400 according to the fourth embodiment to obtain the same advantageous effects as the first to the third embodiments. In addition, since the height 7*d* of the level difference surface 25*d* of the substrate 2*d* is configured to be not less than the diameter 6 of the coaxial cable 1, it is possible to make the height 4*d* of the attachment part of the coaxial cable 1 to the substrate 2*d* less than the thickness 5*d* of the first flat section 23*d* of the substrate 2*d* and to connect the coaxial cable 1 to the substrate 2*d* without causing an increase in the height 4*d* of the attachment part. The cable connection structure 400 can be applied to a connection between an ultrasonic transducer of an ultrasonic endoscope and a coaxial cable, for example.

Fifth Embodiment

Figure 6:
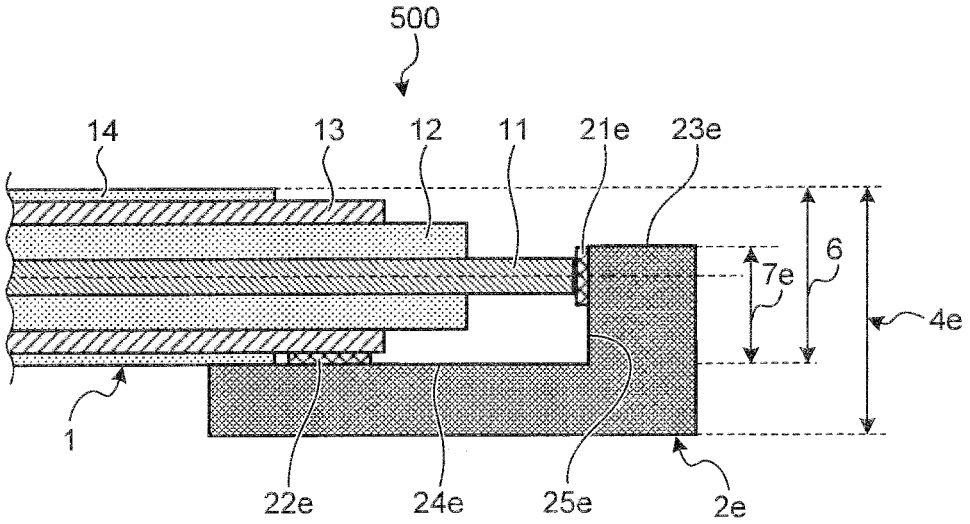
FIG. 6 is a partial cross sectional view of a cable connection structure according to a fifth embodiment.

FIG. 6 is a partial cross sectional view of a cable connection structure 500 according to a fifth embodiment. In FIG. 6, the same part as the first to the fourth embodiments is assigned with the same reference symbol. As shown in FIG. 6, the cable connection structure 500 according to the fifth embodiment is configured such that a height 7*e* of a level difference surface 25*e* between a first flat section 23*e* and a second flat section 24*e* of a substrate 2*e* is equal to or less than the diameter 6 of the coaxial cable 1. As shown in FIG. 6, a center conductor connecting electrode 21*e* is formed on the level difference surface 25*e* (vertical surface) of the substrate 2*e* in the coaxial cable connection structure 500 according to the fifth embodiment.

The coaxial cable 1 and the substrate 2*e* are electrically and mechanically connected by a conductive bonding member, not shown, such as a solder and an ACF similarly to the first to the fourth embodiments. Specifically, the end part of the center conductor 11 of the coaxial cable 1 and the center conductor connecting electrode 21*e*, and the end part of the external conductor 13 and an external conductor connecting electrode 22*e* are electrically and mechanically connected by a conductive bonding member, not shown, such as a solder, an ACF, and an ACP.

As explained so far, it is possible in the cable connection structure 500 according to the fifth embodiment to obtain the same effect as the first embodiment. Specifically, it is possible to reduce a height 4*e* of the attachment part of the coaxial cable 1 by the height 7*e* of the level difference surface 25*e*. In addition, there becomes no necessity of forming the center conductor connecting electrode 21*e* on a main surface of the first flat section 23*e* and a main surface of the second flat section 24*e*.

Thanks to the effect explained above, it is possible in the cable connection structure 500 according to the fifth embodiment to obtain the same advantageous effects as the first embodiment. In addition, it is possible to make an area of the first flat section 23*e* and the second flat section 24*e* small since the center conductor connecting electrode 21*e* is arranged on the level difference surface 25*e* of the substrate 2*e* and there becomes no necessity of forming the center conductor connecting electrode 21*e* on the main surface of the first flat section 23*e* and the main surface of the second flat section 24*e*. Therefore, it is possible to make a dimension, necessary for connecting the coaxial cable 1 to the substrate 2*e*, of the substrate 2*e* in a longitudinal direction of the coaxial cable 1 small. The cable connection structure 500 can be applied to a connection between an ultrasonic transducer of an ultrasonic endoscope and a coaxial cable, for example.

Figure 7:
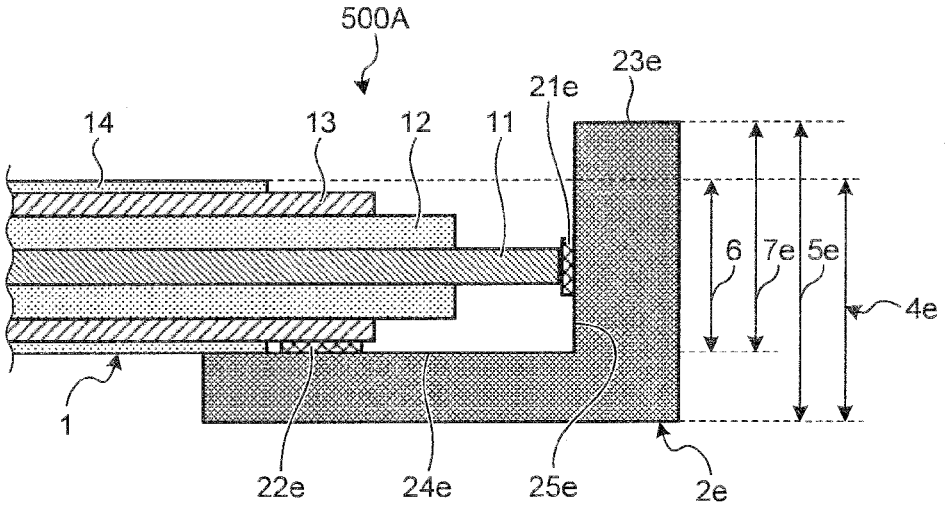
FIG. 7 is a partial cross sectional view of a cable connection structure according to a first modification of the fifth embodiment.

Besides, a cable connection structure 500A in which the height 7*e* of the level difference surface 25*e* between the first flat section 23*e* and the second flat section 24*e* of the substrate 2*e* is configured to be equal to or more than the diameter 6 of the coaxial cable 1 is taken as a first modification of the fifth embodiment. FIG. 7 is a partial cross sectional view explaining the cable connection structure 500A according to the modification of the fifth embodiment. As shown in FIG. 7, the center conductor connecting electrode 21*e* is formed on the level difference surface 25*e* (vertical surface) of the substrate 2*e* in the cable connection structure 500A according to the first modification of the fifth embodiment.

According to the first modification of the fifth embodiment, it is possible to make the height 4*e* of the attachment part of the coaxial cable 1 to the substrate 2*e* less than a thickness 5*e* of the first flat section 23*e* of the substrate 2*e* and to connect the coaxial cable 1 to the substrate 2*e* without causing an increase in the height 4*e* of the attachment part. In addition, it is possible to make the area of the first flat section 23*e* and the second flat section 24*e* small since the center conductor connecting electrode 21*e* is arranged on the level difference surface 25*e* of the substrate 2*e* and there becomes no necessity of forming the center conductor connecting electrode 21*e* on the main surface of the first flat section 23*e* and the main surface of the second flat section 24*e*. Therefore, it is possible to make the dimension, necessary for connecting the coaxial cable 1 to the substrate 2*e*, of the substrate 2*e* in the longitudinal direction of the coaxial cable 1 small.

Sixth Embodiment

Figure 8:
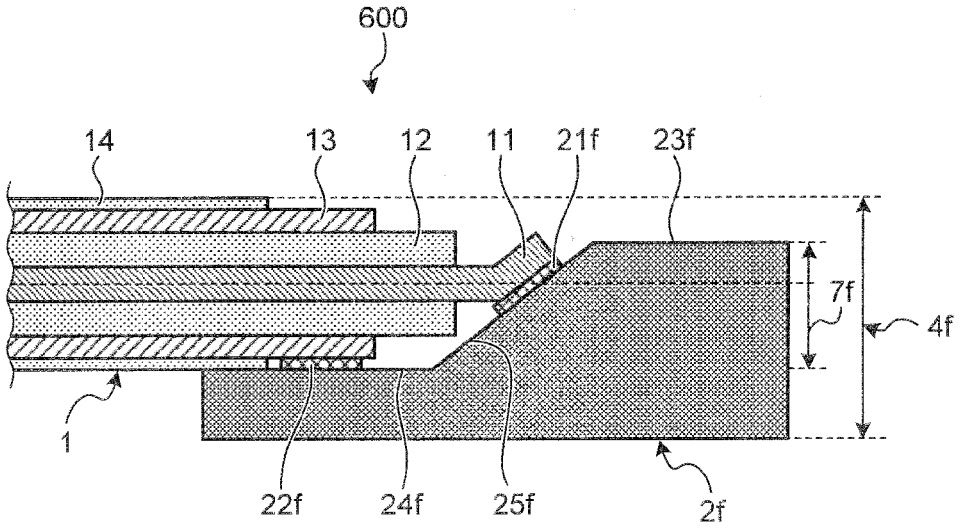
FIG. 8 is a partial cross sectional view of a cable connection structure according to a sixth embodiment.

FIG. 8 is a partial cross sectional view of a cable connection structure 600 according to a sixth embodiment. In FIG. 8, the same part as the first to the fifth embodiments is assigned with the same reference symbol. As shown in FIG. 8, the cable connection structure 600 according to the sixth embodiment is configured such that a height 7*f* of a level difference surface 25*f* between a first flat section 23*f* and a second flat section 24*f* of a substrate 2*f* is equal to or less than the diameter of the coaxial cable 1. As shown in FIG. 8, the level difference surface 25*f* between the first flat section 23*f* and the second flat section 24*f* of the substrate 2*f* is formed as a slope surface not perpendicular to main surfaces of the first flat section 23*f* and the second flat section 24*f* in the cable connection structure 600 according to the sixth embodiment.

Here, the substrate 2*f* is assumed to be a silicon substrate and the level difference surface 25*f* is obtained as a slope surface by a process through an anisotropic etching of a predetermined side surface of the substrate 2*f*, for example. After forming the level difference surface 25*f*, an external conductor connecting electrode 22*f* is formed on the main surface of the second flat section 24*f* and a center conductor connecting electrode 21*f* is formed on the level difference surface 25*f* as a slope surface.

The substrate 2*f* is not limited to the case of being constituted by a silicon substrate, and a ceramic substrate and the like may be similarly applied. When a ceramic substrate is used for the substrate 2*f*, an electrode can be formed on the level difference surface 25*f* as a slope surface by laminating ceramic layers in which electrode layers are formed at an edge part.

The coaxial cable 1 and the substrate 2*f* are electrically and mechanically connected by a conductive bonding member, not shown, such as a solder and an ACF similarly to the first to the fifth embodiments. Specifically, the end part of the center conductor 11 of the coaxial cable 1 and the center conductor connecting electrode 21*f*, and the end part of the external conductor 13 and the external conductor connecting electrode 22*f* are electrically and mechanically connected by a conductive bonding member, not shown, such as a solder, an ACF, and an ACP.

As explained so far, it is possible in the cable connection structure 600 according to the sixth embodiment to obtain the same effect as the first embodiment. Specifically, it is possible to reduce a height 4*f* of the attachment part of the coaxial cable 1 by the height 7*f* of the level difference surface 25*f*. Therefore, it is possible to suppress an increase, associated with the connection of the coaxial cable 1, in the direction of the thickness of the substrate 2*f*. In addition, since the level difference surface 25*f* of the substrate 2*f* is configured not to be perpendicular but to be a slope surface and the center conductor connecting electrode 21*f* is arranged on the level difference surface 25*f*, it is possible to make a projection area of the center conductor connecting electrode 21*f* in the direction perpendicular to the main surface of the first flat section 23*f* and the main surface of the second flat section 24*f* small without making a connection area between the center conductor connecting electrode 21*f* and the end part of the center conductor 11 small.

Thanks to the effect explained above, it is possible in the cable connection structure 600 according to the sixth embodiment to obtain the same advantageous effects as the first embodiment. In addition, since it is possible to make the projection area in the direction perpendicular to the main surface of the first flat section 23*f* and the main surface of the second flat section 24*f* small without making an area of the center conductor connecting electrode 21*f* small, it is possible to make a dimension necessary for the connection small without changing a connectivity of the center conductor 11. The cable connection structure 600 can be applied to a connection between an ultrasonic transducer of an ultrasonic endoscope and a coaxial cable, for example. While the center conductor connecting electrode 21*f* and the end part of the center conductor 11 are connected via a circumference of the outer diameter of the center conductor 11 in the cable connection structure 600 according to the sixth embodiment as shown in FIG. 8, a distal end part of the center conductor 11 may be formed to have a slope surface whose inclination is substantially the same as that of the level difference surface 25*f* and the slope surface formed at the distal end of the center conductor 11 and the center conductor connecting electrode 21*f* on the level difference surface 25*f* may be connected by a conductive film and the like to connect the center conductor 11 and the center conductor connecting electrode 21*f*.

Figure 9:
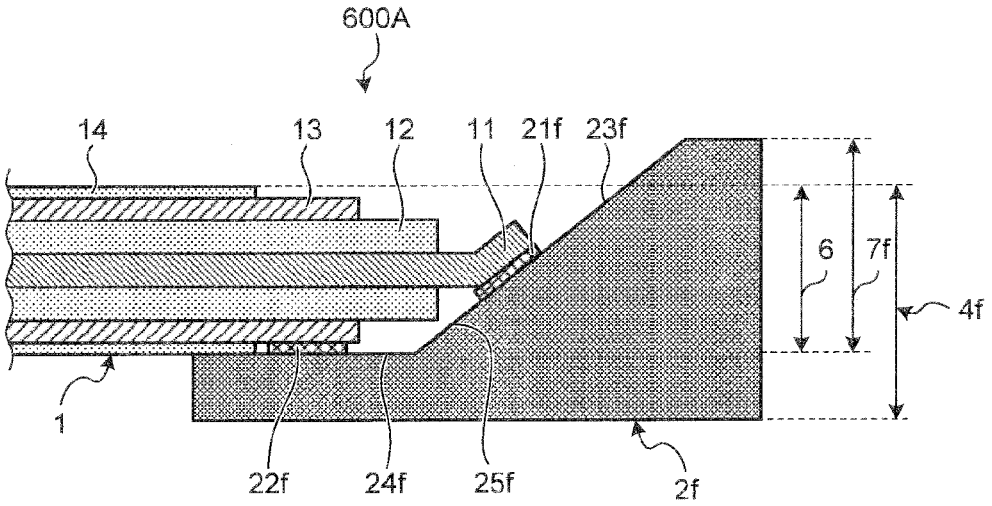
FIG. 9 is a partial cross sectional view of a cable connection structure according to a first modification of the sixth embodiment.

Besides, a cable connection structure 600A in which the height 7*f* of the level difference surface 25*f* between the first flat section 23*f* and the second flat section 24*f* of the substrate 2*f* is configured to be equal to or more than the diameter 6 of the coaxial cable 1 is taken as a first modification of the sixth embodiment. FIG. 9 is a partial cross sectional view of a cable connection structure 600A according to the first modification of the sixth embodiment. As shown in FIG. 9, the center conductor connecting electrode 21*f* is formed on the level difference surface 25*f* as a slope surface in the cable connection structure 600A according to the first modification of the sixth embodiment.

According to the first modification of the sixth embodiment, it is possible to make the height 4*f* of the attachment part of the coaxial cable 1 to the substrate 2*f* less than the thickness of the first flat section 23*f* of the substrate 2*f* and to connect the coaxial cable 1 to the substrate 2*f* without causing an increase in the height 4*f* of the attachment part since the height 7*f* of the level difference surface 25*f* is made more than the diameter 6 of the coaxial cable 1. In addition, since the level difference surface 25*f* of the substrate 2*f* is configured to be a slope surface which is not perpendicular to the main surfaces of the first flat section 23*f* and the second flat section 24*f* of the substrate 2*f* and the center conductor connecting electrode 21*f* is arranged on the level difference surface 25*f*, it is possible to make a projection area of the center conductor connecting electrode 21*f* in the direction perpendicular to the main surface of the first flat section 23*f* and the main surface of the second flat section 24*f* small without making a connection area of the end part of the center conductor 11 to the center conductor connecting electrode 21*f* small.

Figure 10:
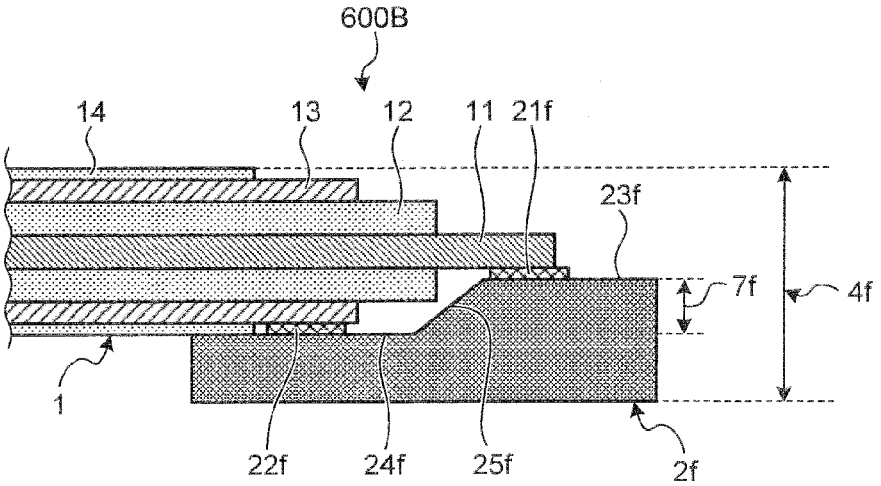
FIG. 10 is a partial cross sectional view of a cable connection structure according to a second modification of the sixth embodiment.

Moreover, a cable connection structure 600B in which the center conductor connecting electrode 21*f* is formed on the main surface of the first flat section 23*f* is taken as a second modification of the sixth embodiment. FIG. 10 is a partial cross sectional view of a cable connection structure 600B according to the second modification of the sixth embodiment. As shown in FIG. 10, the level difference surface 25*f* between the first flat section 23*f* and the second flat section 24*f* of the substrate 2*f* is formed as a slope surface with respect to the main surfaces of the first flat section 23*f* and the second flat section 24*f* in the cable connection structure 600B according to the second modification of the sixth embodiment.

According to the second modification of the sixth embodiment, it is possible to reduce the height 4*f* of the attachment part of the coaxial cable 1 by the height 7*f* of the level difference surface 25*f*.

While the case of connecting a coaxial cable to a substrate is exemplified in the embodiments explained above, the present invention is not limited to the embodiments and may be applied to a cable of other kinds except for the coaxial cable, for example, a cable in which one or more conducting wire is covered by an outer skin. In this case, by connecting at least one conducting wire to the second flat section as a thinner part of the substrate or the level difference surface, it is possible to connect the cable to the substrate with a reduction in height of the cable attachment part.

In the cable connection structure according to the present invention, there are advantageous effects in that a height of an attachment part of the cable to the substrate can be reduced by a height of the level difference surface formed in the substrate, or the cable can be connected to the substrate without causing an increase in height of the attachment part when the height of the level difference surface is more than a diameter of the cable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable connection structure comprising:

a cable that has an outer insulator, a core wire and a shielding wire; and a substrate to which the cable is connected on a main surface side having a hard wiring, wherein the substrate includes, on the main surface side, a first flat section having flatness, a second flat section having flatness whose thickness along a width direction of the cable is less than that of the first flat section, and a level difference surface that is a slope surface with respect to the first flat section and the second flat section, and the level difference surface joins the first flat section and the second flat section, an end part of the outer insulator is arranged on the second flat section, and an end part of the shielding wire is connected to a first connecting electrode formed on the second flat section; and an end part of the core wire is connected to a second connecting electrode formed on the second flat section;

wherein a height of the level difference surface between the second flat section and the first flat section is not less than a radius of the cable.

2. A cable connection structure comprising:

a coaxial cable that has an outer insulator, a core wire, and a shielding wire; and a substrate to which the coaxial cable is connected on a main surface side having a hard wiring, wherein the substrate includes, on the main surface side, a first flat section having flatness, a second flat section having flatness whose thickness along a width direction of the cable is less than that of the first flat section, and a level difference surface that is perpendicular to the first flat section and the second flat section, and the level difference surface joins the first flat section and the second flat section, an end part of the outer insulator is arranged on the second flat section, an end part of the shielding wire is connected to a connecting electrode formed on the second flat section, and an end part of the core wire is directly connected to a connecting electrode formed on the level difference surface.

* * * * *